United States Patent [19]

Ohshima et al.

[11] Patent Number: 4,916,053

[45] Date of Patent: Apr. 10, 1990

[54] SILVER HALIDE PHOTOGRAPHIC MATERIAL

[75] Inventors: Naoto Ohshima; Toshiaki Hayakawa; Shunji Takada, all of Kanagawa, Japan

[73] Assignee: Fuji Photo Film Co., Ltd., Kanagawa, Japan

[21] Appl. No.: 245,922

[22] Filed: Sep. 16, 1988

Related U.S. Application Data

[63] Continuation of Ser. No. 878,538, Jun. 25, 1986, abandoned.

[30] Foreign Application Priority Data

Jun. 25, 1985 [JP] Japan ..... 60-138775

[51] Int. Cl.[4] ..... G03C 1/10

[52] U.S. Cl. ..... 430/599; 430/567; 430/600; 430/609; 430/627; 430/630

[58] Field of Search ..... 430/567, 599, 600, 609, 430/627, 630

[56] References Cited

U.S. PATENT DOCUMENTS

| | | | |
|---|---|---|---|
| 3,730,726 | 5/1973 | Tsuji et al. | 430/381 |
| 4,045,226 | 8/1977 | Hara et al. | 430/627 |
| 4,120,725 | 10/1978 | Nakazyo et al. | 430/627 |
| 4,431,730 | 2/1984 | Urabe et al. | 430/604 |
| 4,431,731 | 2/1984 | Sugimoto et al. | 430/600 |
| 4,528,264 | 7/1985 | Ishiguro et al. | 430/600 |
| 4,565,778 | 1/1986 | Miyamoto et al. | 430/567 |
| 4,581,328 | 4/1986 | Matsuyama | 430/599 |
| 4,610,958 | 9/1986 | Matsuzaka et al. | 430/567 |
| 4,668,614 | 5/1987 | Takada et al. | 430/599 |

*Primary Examiner*—Hoa Van Le
*Attorney, Agent, or Firm*—Sughrue, Mion, Zinn, Macpeak & Seas

[57] ABSTRACT

A negative-tupe silver halide photographic material is provided, having high sensitivity and good graininess with low fog. The material has at least one silver halide emulsion layer on a support, wherein chemically-sensitized silver halide grains contained in the emulsion of said emulsion layer comprise normal crystalline grains, and said emulsion layer containing said normal crystalline silver halide grains contains a polymer having a repeating unit represented by formula (I):

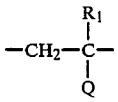

(I)

wherein $R_1$ represents a hydrogen atom or an alkyl group; Q represents one group selected from formulae (i), (ii), (iii), and (iv);

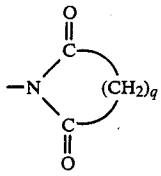

(i)

wherein q is an integer of from 2 to 4;

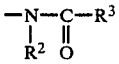

(ii)

wherein $R^2$ and $R^3$ each represents a hydrogen atom or an alkyl group;

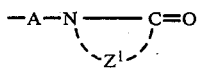

(iii)

wherein $Z^1$ represents an atomic group forming a lactam ring, an oxazolidone ring, or a pyridone ring;

A represents a single bond,

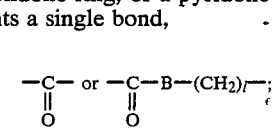

B represents —O— or

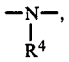

wherein $R^4$ represents a hydrogen atom or an alkyl group; and l is an integer of from 1 to 6; and

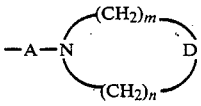

(iv)

wherein a has the same meaning as defined for formula (iii);

D represents a single bond, —O— or

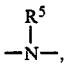

wherein $R^5$ represents a hydrogen atom, an alkyl group, or

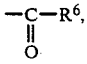

wherein $R_6$ represents an alkyl group, and m and n each represents an integer of from 1 to 6, provided that the sum of m and n is an integer of from 4 to 7.

15 Claims, No Drawings

SILVER HALIDE PHOTOGRAPHIC MATERIAL

This is a continuation of application Ser. No. 06/878,538 filed June 25, 1986, now abandoned.

FIELD OF THE INVENTION

The present invention relates to silver halide photographic materials, and in particular, to negative-type silver halide photographic materials of high sensitivity and good graininess.

BACKGROUND OF THE INVENTION

In the field of the silver halide photograhic materials, especially those intended for camera use, recently, photographic materials of ultra-high sensitivity have become widely used, and ISO 1600-color negative film is a typical example. In order to enhance the sensitivity of photographic materials, it has heretofore been propelled to enlarge the size of the silver halide grains contained in said materials, which, however, results in deterioration of the graininess of said grains. In conventional films of ISO 100 and 400, the size thereof has recently been required to be a small format one, and therefore it is requested to make the graininess of the silver halide grains used in said films further better.

It is generally known that a monodispersion emulsion having a uniform grain size distribution is superior to a polydispersion emulsion in that the graininess in the toe region of the characteristic curve thereof is especially excellent. Among said monodispersion emulsions, in particular, normal crystalline grains can be controlled during the formation step of the grains or during the chemical sensitization step thereof, without any remarkable variation of the grain (e.g., variation of the grain size, variation of the form, variation of the sensibility, etc.) and thereby can obtain excellent graininess. Accordingly, said normal crystalline grains bring a great merit in order to enhance the sensitivity in this industrial field. These are described in T. H. James, *The Theory of the Photographic Process*, Fourth Edition, Chapter 21, The Macmillan, 1977.

SUMMARY OF THE INVENTION

An object of the present invention is to provide a negative-type silver halide photographic materials having high sensitivity and good graininess with low fog.

The present inventors have extensively studied the matter, and have now found that said object of the present invention can be attained by incorporating into a silver halide emulsion layer wherein chemically-sensitized negative-type silver halide grains comprise normal crystalline grains, a polymer having a repeating unit of formula (I);

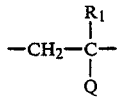

(I)

wherein $R^1$ represents a hydrogen atom or an alkyl group; Q represents one group selected from formulae (i), (ii), (iii), and (iv)

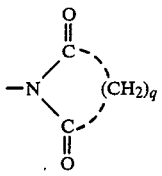

(i)

wherein q is an integer of from 2 to 4;

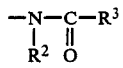

(ii)

wherein $R^2$ and $R^3$ each represents a hydrogen atom or an alkyl group;

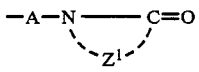

(iii)

wherein $Z^1$ represents an atomic group forming a lactam ring, an oxazolidone ring, or a pyridone ring;

A represents a single bond,

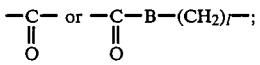

B represents —O— or

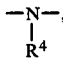

wherein $R^4$ represents a hydrogen atom or an alkyl group; and l is an integer of from 1 to 6; and

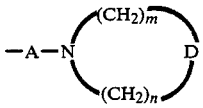

(iv)

wherein

A has the same meaning as defined for formula (iii);

D represents a single bond, —O— or

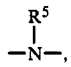

wherein $R^5$ represents a hydrogen atom, an alkyl group, or

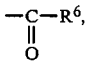

wherein $R^6$ represents an alkyl group; and m and n each represents an integer of from 1 to 6, provided that the sum of m and n is an integer of from 4 to 7.

Accordingly, the present invention provides a negative-type silver halide photographic material having at least one silver halide emulsion layer on a support, wherein the chemically-sensitized silver halide grains contained in the emulsion of the emulsion layer comprise normal crystalline grains, and said emulsion layer containing said normal crystalline silver halide grains contains a polymer having a repeating unit represented by formula (I).

DETAILED DESCRIPTION OF THE INVENTION

The polymers of formula (I) have heretofore been considered to be a substitutive substance for a conventional binder such as gelatin. U.S. Pat. No. 4,431,730 describes certain characteristics of said polymers, particularly that when the surface of an internal latent image-type direct positive silver halide emulsion is chemically-sensitized in the presence of said polymer, $D_{max}$ (maximum density) of the reversal image becomes higher and the other reversal photographic characteristics are not deteriorated at all.

In a surface latent image-type emulsion for obtaining negative images, however, whose surfaces have been chemically-sensitized (for example, by gold- and/or sulfur-sensitization), the present inventors have found the fact, as shown in the examples hereinafter given in the present specification, that, if the polymer of formula (I) of the present invention is incorporated in a conventional amorphous silver halide emulsion layer containing twinned-type crystalline grains, no sensitization effect is obtained. However, the inventors have surprisingly found that if the polymer of formula (I) is incorporated in a silver halide emulsion containing normal crystalline grains according to the present invention, a sensitization effect of the emulsion can be attained. This discovery was quite unexpected.

Furthermore, if the polymer of formula (I) of the present invention is combined with a normal crystalline emulsion having a distinct stratiform structure, which is explained in detail hereinafter, the sensitization effect is even more remarkable, and this is still further unexpected. The mechanism has not as yet been clarified.

Normal crystalline grains in the present invention include regular crystalline grains (normal crystals) such as cubic, octahedral, dodecahedral, and tetradecahedral crystalline grains, and in addition, further include somewhat roundish grains derived therefrom where the corner parts or edge parts are broken in some degree.

The emulsion of the present invention may contain any other grains in addition to the normal crystalline grains, such as pebble-like grains, tabular grains, etc.; and the volume fraction of the normal crystalline grains in the emulsion is preferably 50% or more, and more preferably 75% or more.

In case of normal crystals, grains having 50% or more of the face (111) are particularly suitable.

The face rate of the face (111) can be determined by a Kubelka-Munk's dye absorption procedure. In this process, a dye which is preferentially absorbed on either the face (111) or the face (100), wherein the association state of the dye on the face (111) is spectrometrically different from that of the dye on the face (100), is selected. Such a dye is added to the emulsion, and spectra to the amount of the dye added are examined in detail by generally known methods, by which the face rate of the face (111) can be determined.

The grain size of silver halide grains of the present invention is not particularly limited, but it is preferably 0.4 μm or more, more preferably 0.8 μm or more, and particularly preferably from 1.4 to 3.0 μm.

The halogen composition of the silver halide grains preferably comprises normal crystalline grains containing from 60 to 100 mole % silver bromide and up to 20 mole % silver chloride, and more preferably comprises normal crystalline grains containing 2 to 30 mole % of silver iodine, and particularly preferably comprises normal crystalline grains containing from 7 to 25 mole % of silver iodine. Further, the silver halide grains having the same halogen composition ratio in each of the grains are preferred.

The most preferred halogen composition in the silver halide grains has substantially two distinct stratiform structures comprising a core part of a high iodine layer and a shell part of a low iodine layer. Grains having such a structure are explained in more detail hereunder.

The distinct stratiform structure as described herein can be confirmed by X-ray diffractiometry. An example of applying the X-ray diffractiometry to silver halide grains has been described in H. Hirsch, *Journal of Photographic Science*, Vol. 10 (1962), pp. 129. When the lattice constant is determined on the basis of halogen composition, a diffraction peak is formed in the angle of diffraction which satisfies Bragg's condition ($2d \sin \theta = n\lambda$).

The manner of measuring the X-ray diffraction has been described in detail in "X-Sen Bunseki" (X-Ray Analysis), *Kiso Bunseki Kagaku Koza* (Lecture of Fundamental Analysis Chemistry), published by Kyoritsu Shuppan and *X-Sen Kaiseki No Tebiki* (Manual of X-Ray Diffraction), published by Rigaku Denki Co. A standard method of measurement is carried out in such a manner that a diffraction curve of the face (220) of the silver halide is determined by using Cu as a target with a Kβ ray of Cu as a ray source (tube electric potential: 40 KV, tube electric current: 60 mA). In order to increase the resolving power of the apparatus for measurement, it is necessary to confirm the accuracy of the measurement by using a standard sample such as silicon, etc., and selecting a suitable slit width (radiation slit, light receiving slit, etc.), time constant of the apparatus, scanning rate of the goniometer, and recording rate.

When emulsion grains which have a distinct stratiform structure having two parts are used, a diffraction maximum due to silver halide in the high silver iodide content core and a diffraction maxium due to silver halide in the low silver iodide content shell part of the uppermost layer appear, whereby two peaks are formed on the diffraction curve.

The distinct stratiform structure having substantially two parts in the present invention means that when a curve of diffraction intensity of the face (220) of silver halide to angle of diffraction (2Θ) is obtained using a Kβ ray of Cu in a range of an angle of diffraction of from 38° to 42°, two diffraction maximums of a diffraction peak corresponding to the high silver iodide content core containing from 10 to 45 mole % of silver iodide and a diffraction peak corresponding to the low silver iodide content shell part of the uppermost layer containing 5 mole % or less of silver iodide appear and one minimum appears between them, the diffraction intensity of the peak corresponding to the high silver iodide content core is from 1/10 to 3/1, preferably from 1/5 to 3/1, more preferably from 1/3 to 3/1, of the diffraction intensity of the peak corresponding to the low silver iodide content shell part of the uppermost layer.

As emulsions having a distinct stratiform structure having substantially two parts in the present invention, those wherein the diffraction intensity of the minimum value between two peaks is 90% or less of the diffraction maximum (peak) having the lower intensity of the two diffraction maximums are preferred.

For the minimum between the two peaks, 80% or less is more preferred and 60% or less is particularly preferred.

The manner of analyzing the diffraction curve composed of two diffraction components is well known and described in, for example, "Koshi Kekkan" (Failure of Lattice), *Jikken Butsurigaku Koza* (Lecture of Experimental Physics), No. 11, published by Kyoritsu Shuppan.

It is effective to analyze the curve with a curve analyzer produced by E.I. Du Pont de Nemours and Company on the assumption that it is a function such as a Gauss function or a Lorentz function .

In an emulsion containing two kinds of grains, having a different halogen composition, which do not have a distinct stratiform structure, two peaks also appear in the above described X-ray diffraction pattern. However, such an emulsion cannot show excellent photographic performances as obtained in the present invention.

Whether the silver halide emulsion is an emulsion having a distinct stratiform structure of the present invention or the aforesaid emulsion wherein two kinds of silver halide grains are present can be judged by an EPMA process (Electron-Probe Micro Analyzer process) in addition to X-ray diffractometry.

In the EPMA process, a sample in which emulsion grains are well dispered so as not to contact one another is produced, and irradiated with electron beams. Elemental analysis of very fine parts can be carried out by X-ray analysis of electron ray excitation.

According to the EPMA process, the halogen composition of individual grains can be determined by measuring the X-ray intensities of silver and iodine emitted from each grain.

It can be determined whether or not the emulsion is that of the present invention, if the halogen composition of at least 50 grains is confirmed by the EPMA process.

In the emulsions having a distinct stratiform structure of the present invention, it is preferred that the silver iodide content of each grain is uniform.

It is preferred, when measuring the distribution of the silver iodide content of the grains, that the standard deviation is 50% or less, more preferably 35% or less, and particularly preferably 20% or less.

As the halogen composition of silver halide grains having a distinct stratiform structure of the present invention, preferred examples are as follows.

The core part is silver halide having a high iodide content, wherein the iodide content is preferred to be in a range of from 10 to 45 mole % which is the limited amount of solid solution. The silver iodide content is preferably in a range of from 15 to 45 mole %, and more preferably from 20 to 45 mole %.

In the core part, the silver halide other than silver iodide may be either or both of silver chlorobromide and silver bromide, but it is preferred that the amount of silver bromide is higher.

The composition of the shell part of the uppermost layer preferably consists of silver halides containing 5 mole % or less of silver iodide and, more preferably, silver halides containing 2 mole % or less of silver iodide.

In the shell part of the uppermost layer, the silver halide other than silver iodide may be any of silver chloride, silver chlorobromide, and silver bromide, but it is preferred that the amount of silver bromide is higher than the amount of the other silver halide.

When the total silver iodide content of the whole grains is 7 mole % or more, the effect of the present invention is especially remarkable. A preferable total silver iodide content of the whole grain is 9 mole % or more, and, particularly preferably, from 12 to 25 mole %.

In order to obtain suitable photographic properties in the emulsions comprising silver halide grains having a distinct stratiform structure, the core composed of silver halide having a high silver iodide content should be sufficiently coated with the shell composed of silver halide having a low silver iodide content. The thickness of the shell depends upon grain size, but it is preferred that large grains having a grain size of 1.0 μm or more are coated with a shell having a thickness of 0.1 μm or more and small grains having a grain size of less than 1.0 μm are coated with a shell having a thickness of 0.05 μm or more. In order to obtain emulsions having a distinct stratiform structure, the ratio of silver content in the core part of the shell part is preferred to be in a range of from 1/5 to 5/1, more preferably from 1/5 to 3/1, and particularly preferably from 1/5 to 2/1.

As described above, silver halide grains which have a distinct stratiform structure having substantially two parts means that the grains have substantially two regions, each having a different halogen composition, wherein the center side of the grains is called the core part and the surface side is called the shell part.

The phrase "substantially two parts" means that a third region other than the core part and the shell part (for example, a layer between the central core part and the uppermost shell part) may be present.

However, the third region should be present only to the extent of not having a substantial influence upon the shape of the two peaks (which correspond to the part having a high silver iodide content and the part having a low silver iodide content) when an X-ray diffraction pattern is obtained as described above.

Namely, silver halide grains wherein a core part having a high silver iodide content, an intermediate part, and a shell part having a low silver iodide content are present, two peaks are present and one minimum part is present between the two peaks in the X-ray diffraction pattern, the diffraction intensity corresponding to the part having a high silver iodide content is from 1/10 to 3/1, preferably from 1/5 to 3/1 and, particularly preferably from 1/3 to 3/1 of that of the part having a low silver iodide content, and the diffraction intensity of the minimum part is 90% or less, preferably 80% or less, and, particularly preferably 70% or less of the smaller peak of two peaks, are grains having a distinct stratiform structure having substantially two parts.

The case wherein a third region is present in the inside of the core part is similar to the above-described case.

Regarding the grain size distribution of the normal crystalline grain of the present invention, the variation coefficient S/V, which relates to the grain size of silver halide grains, is preferably 0.25 or less, more preferably 0.15 or less. V is an average grain size and S is a standard deviation on the grain size.

The normal crystalline grains which is used in the present invention may be prepared in a conventional manner. The details are described in *Research Disclosure*, Vol. 176, RD No. 17643, Items I and II (December, 1978), which may be applied to the case of the present invention.

The emulsions having a distinct stratiform structure of the present invention can be prepared by selecting from the combining various processes known in the field of silver halide photographic material and *Research Disclosure* as described above.

In order to prepare core grains, the process can be selected from an acid process, a neutral process, an ammonia process, etc.

As one type of the simultaneous mixing process, a process wherein pAg in a liquid phase in which silver halide is formed is kept constant, namely, a controlled double jet process, can be preferably used. As another type of the simultaneous mixing process, a triple jet process which comprises adding separately soluble halogen salts having each a different composition (for example, a soluble silver salt, a soluble bromide, and a soluble iodide) can be used, too. Solvents for silver halide such as ammonia, rhodanides, thioureas, thioethers, amines, etc., may be used when preparing the core part. Emulsions in which the distribution of grain size of core grains is narrow are suitable. Emulsions in which halogen composition, particularly silver iodide content, of each grain is more uniform in the stage of preparing the core are preferred.

Whether the halogen composition of each grain is uniform or not can be judged by the above-described X-ray diffractiometry and the EPMA process. In the case that the halogen composition of core grains is more uniform, the diffraction width of the X-ray diffraction pattern is narrow, giving a sharp peak.

For the preparation of silver halide grains having a distinct stratiform structure used in the present invention, the shell part may directly be provided on the core grains, immediately after the formation of said core grains, but it is preferred that the shell part is provided thereon after the core emulsion has been washed with water for demineralization.

For the provision of the shell part on the core grain, various conventional means which are well known in the field of silver halide photographic materials may be used, and in particular, a simultaneous mixing process, especially a controlled-double jet method, is preferred.

The silver halide emulsion of the present invention is chemically-sensitized. Chemical sensitization can be carried out by processes as described, e.g., in H. Frieser (ed.), *Die Grundlagen der Photographischen Prozesse mit Silberhalogeniden*, pp. 675–734, Akademisch Verlagsgesellschaft (1968).

More specifically, chemical sensitization can be carried out by sulfur sensitization using compounds containing sulfur capable of reacting with active gelatin or silver ions (e.g., thiosulfates, thioreas, mercapto compounds, rhodanines, etc.); reduction sensitization using reducing materials (e.g, stannous salts, amines, hydrazine derivatives, formamidinesulfinic acid, silane compounds, etc.); noble metal sensitization using noble metal compounds (e.g., gold complexes, and complexes of Periodic Table Group VIII metals such as Pt, Ir, Pd, etc.); and the like individually or in combinations thereof.

Specific examples of sulfur sensitization are described in U.S. Pat. Nos. 1,574,944, 2,410,689, 2,278,947, 2,728,668, 3,656,955, etc. Specific examples of reduction sensitization are described in U.S. Pat. Nos. 2,983,609, 2,419,974, 4,054,458, etc. Specific examples of noble metal sensitization are described in U.S. Pat. Nos. 2,399,083, 2,448,060, British Pat. No. 618,061, etc.

The amount of the aforesaid polymer of formula (I) to be used in the present invention is to properly vary, in accordance with various conditions such as the kind of said polymer and the normal crystalline grains to be used together therewith; and in general, the amount of said polymer to be used may be smaller than the amount of said polymer which is to be used as a protective colloid or a binder, whereby the effect of the present invention may well be attained. In general, the amount of the present polymer to be used is from 0.02 to 10 g, preferably from 0.02 to 5 g, and more preferably from 0.1 to 2 g, per mole of silver used, as calculated in terms of the weight of the repeating unit of formula (I) which constitutes the present polymer.

Now, the polymers of the present invention will be explained in greater detail hereunder.

The polymers of the present invention are those having a repeating unit of the aforesaid formula (I). Preferably, $R^1$ in formula (I) represents a hydrogen atom and Q in formula (I) represents a group selected from the groups (1), (2), (3), and (4) below:

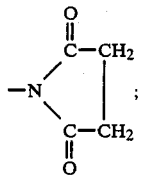
(1)

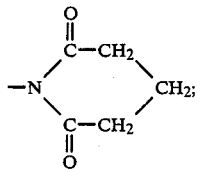
(2)

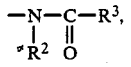
(3)

wherein $R_2$ represents a methyl group or an ethyl group, and $R^3$ represents a hydrogen atom, a methyl group, or an ethyl group;

(4)

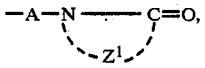

wherein A represents a single bond or

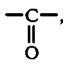

and $Z^1$ forms a 5-membered or 6-membered lactam ring or oxazolidone ring.

Among said cases, Q preferably represents

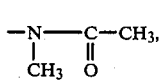

a pyrrolidone group, or an oxazolidone group, and particularly preferably Q represents a pyrroidone group.

The polymers having the repeating units of formula (I) may be either homo-polymers or co-polymers.

More precisely, the polymers to be used in the present invention may be homo-polymers of momomers of the following formula (IA) or copolymers of two or more of said monomers or copolymers of said monomers with other ethylenic unsaturated compounds which may be copolymerizable therewith by addition-polymerization.

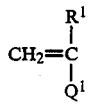

(IA)

In formula (IA) $R^1$ has the same meaning as in formula (I); $Q^1$ represents a group selected from the groups (i), (ii), (iii), and (iv):

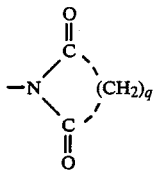

(i)

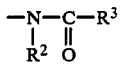

(ii)

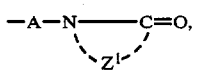

(iii)

or

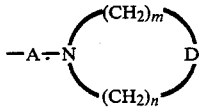

(iv)

wherein q, $R^2$, $R^3$, A, $Z^1$, D, m, and n have the same meanings as in formula (I).l Examples of the monomers of formula (IA) include N-vinyl-succinimide, N-vinylglutarimide, N-vinyladipimide, N-vinylacetamide, N-methyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-s-caprolactam, N-vinyloxazolidone, N-acryloylpyrrolidone, N-acryloyloxyethylpyrrolidone, N-acryloyl-morpholine, N-acryloylpiperidine, N-methacryloylmorpholine, N-(β-morpholinoethyl)acrylamide, N-vinylmorpholine, N-vinyl-2-pyridone, etc. Preferred monomers among them are, for example, N-vinylsuccinimide, N-vinylglutarimide, N-methyl-N-vinylacetamide, N-ethyl-N-vinylacetamide, N-vinylpyrrolidone, N-vinylpiperidone, N-vinyloxazolidone, etc. Especially preferred monomers are N-methyl-N-vinylacetamide, N-vinylpyrrolidone, and N-vinyloxazolidone.

Addition-polymerizable ethylenic unsaturated compounds which may be co-polymerizable with the monomers of formula (IA) to form copolymers include, for example, acrylates, methacrylates, acrylamides, methacrylamides, allyl compounds, vinyl ethers, vinyl esters, vinyl heterocyclic compounds, styrenes, maleates, fumarates, itaconates, crotonates, olefins, etc. Specific examples of said compounds include methyl acrylate, ethyl acrylate, isopropyl acrylate, n-butyl acrylate, octyl acrylate, 2-chloroethyl acrylate, 2-cyanoethyl acrylate, N-(β-dimethylaminoethyl) acrylate, benzyl acrylate, cyclohexyl acrylate, phenyl acrylate; methyl methacrylate, n-propyl methacrylate, isopropyl methacrylate, n-butyl methacrylate, cyclohexyl methacrylate, 3-sulfopropyl methacrylate; allyl-butyl ether, allyl-phenyl ether; methyl-vinyl ether, butyl-vinyl ether, methoxyethyl-vinyl ether, 2-hydroxyethyl-vinyl ether, (2-dimethylaminoethyl)-vinyl ether, vinyl-phenyl ether, vinyl-chlorophenyl ether, acrylamide, methacrylamide, N-methylacrylamide, N-(1,1-dimethyl-3-oxo-butyl)acrylamide, N-(1,1-dimethyl-3-hydroxybutyl)acrylamide, N,N-dimethylacrylamide, acryloyl-hydrazine, N-methoxymethyl-methacrylamide, N-(1,1-dimethyl-3-hydroxybutyl)methacrylamide, N-hydroxymethyl-acrylamide; vinylpyridine, N-vinylimidazole, N-vinylcarbazole, vinyl-thiophene; styrene, chloromethylstyrene, p-acetoxystyrene, p-methylstyrene; p-vinyl-benzoic acid, methyl p-vinyl-benzoate; crotonamide, butyl crotonate, glycerin monocrotonate; methylvinylketone, phenylvinylketone; ethylene, propylene, 1-butene, dicyclopentadiene, 4-methyl-1-hexane, 4,4-dimethyl-1-pentene, etc.; methyl itaconate, ethyl itaconate, diethyl itaconate, etc.; methyl sorbate, ethyl maleate, butyl maleate, dibutyl maleate, octyl maleate, etc.; ethyl fumarate, dibutyl fumarate, octyl fumarate, etc.; halogenated olefins such as vinyl chloride, vinylidene chloride, isoprene, etc.; unsaturated nitriles such as acrylonitrile, methacrylonitrile, etc. These may be used in the form of a mixture of two or more thereof, if desired. Especially preferred compounds among them, in view of the hydrophilic property of the formed polymers therefrom, include acrylic acid, methyacrylic acid, 2-hydroxyethyl acrylate, 2-methoxyethyl acrylate, sulfopropyl acrylate, acrylamide, dimethylacrylamide, 2-acryloylamio-2-methylpropane-sulfonic acid, hydroxyethyl-acrylamide, methylacrylamide, methylvinyl ether, sodium styrene-sulfonate, N-vinyl-3,5-dimethyltriazole, and maleic anhydride. The constitution ratio of the polymers having the repeating unit of the formula (I) is not specifically limited, but the polymers preferably contain from 10 to 100 mole %, and more preferably from 50 to 100 mole %, of the component of formula (I).

The synthesis of the polymers or copolymers having the repeating units of formula (I) may be carried out, by reference to various methods as described, for example, in British Pat. Nos. 1,211,039 and 961,395, Japanese Patent Publication No. 29195/72, Japanese Patent Application (OPI) No. 76593/73 (the term "OPI" as used herein means a "published unexamined Japanese patent application"), British Pat. No. 961,395, U.S. Pat. Nos. 3,227,672, 3,290,417, 3,262,919, 3,245,932, 2,681,897, 3,847,615, 3,840,371, 3,963,495, and 3,230,275, *Official Digest*, by John C. Petropoulos et al, Vol. 33, pp. 719–736 (1961), and *Synthetic High Molecular Compounds*, by S. Murahashi, Vol. 1, pp. 246–290, ibid., Vol. 3, pp. 1–108, etc. The polymerization initiators, the concentration, the polymerization temperature, and the reaction time may widely and routinely be varied in accordance with the particular objects to be achieved.

For instance, the polymerization is generally carried out at a polymerization temperature of from 20° to 180° C., preferably from 40° to 120° C.; and from 0.05 to 5 wt % (to the weight of the monomers to be polymerized)

of a radical-polymerization initiator is used in the polymerization. Examples of initiators are azobis-compounds, peroxides, hydroperoxides, and redox catalysts, such as potassium persulfate, tert-butyl-peroctoate, benzoyl peroxide, azobisisobutyronitrile, 2,2'-azobiscyanovaleric acid, 2,2'-azobis-(2-amidinopropane-hydrochloride), etc.

The aforesaid polymers to be used in the present invention have, in general, a molecular weight of about 2,000 to more, preferably from 8,000 to 700,000 or so. The molecular weight of the polymers, however, is not so critical in the present invention for the purpose of attaining the aimed effect thereof.

Typical examples of the polymers having the repeating units of formula (I) to be used in the present invention are listed hereunder.

(1) poly-(N-vinylpyrrolidone)
(2) poly(N-vinyloxazolidone)
(3) poly(N-vinylsuccinimide)
(4) poly(N-vinylglutarimide)
(5) poly(N-vinylpiperidone)
(6) poly(N-vinyl-ε-caprolactam)
(7) poly(N-methyl-N-vinylacetamide)
(8) poly(N-ethyl-N-vinylacetamide)
(9) poly(N-vinylacetamide)
(10) vinylacohol/N-vinylacetamide copolymer (molar ratio of 30/70)
(11) vinyl alcohol/N-vinylpyrrolidone copolymer (molar ratio of 20/80)
(12) vinyl alcohol/N-vinylpyrrolidone copolymer (molar ratio of 30/70)
(13) N-vinylpyrrolidone/vinyl acetate copolymer (molar ratio of 70/30)
(14) N-vinylpyrrolidone/2-hydroxyethyl acrylate copolymer (molar ratio of 70/30)
(15) N-vinylpyrrolidone/acrylic acid copolymer (molar ratio of 90/10)
(16) N-vinylpyrrolidone/N-vinyl-3,5-dimethyltriazole copolymer (molar ratio of 50/50)
(17) N-vinylpiperidone/2-methoxyethyl acrylate copolymer (molar ratio of 70/30)
(18) N-vinylpiperidone/methylvinyl ether copolymer (molar ratio of 90/10)
(19) N-vinyloxazolidone/vinyl alcohol copolmer (molar ratio of 65/35)
(20) N-vinyloxazolidone/acrylic acid copolymer (molar ratio of 80/20)
(21) N-vinylpyrroidone/N-vinylpiperidone/2-hydroxyethyl acrylate copolymer (molar ratio of 40/30/30)
(22) vinyl alcohol/vinyl acetate/N-vinyl-2-pyridone copolymer (molar ratio of 70/25/5)
(23) N-vinylpyrrolidine/2-hydroxyethyl acrylate/vinyl acetate copolymer (molar ratio of 70/21/10)
(24) N-vinylpyrrolidone/vinyl alcohol/vinyl propionate/sodium styrenesulfonate (molar ratio of 40/40/5/15)
(25) N-vinylpyrrolidone/acrylamide copolymer (molar ratio of 60/40)
(26) N-vinylpyrrolidone/2-acrylamide-2-methylpropane-sulfonic acid copolymer (molar ratio of 75/25)
(27) N-vinylpiperidone/acrylamide copolymer (molar ratio of 60/40)
(28) N-vinyloxazolidone/N-(2-hydroxyethyl)acrylamide copolymer (molar ratio of 70/30)
(29) N-vinylpyrrolidone/N-vinylmorpholine/acrylamide copolymer (molar ratio of 50/20/30)
(30) N-vinylsuccinimide/N-vinyl-ε-caprolactam/acrylamide copolymer (molar ratio of 40/20/40)
(31) N-vinyloxazolidone/acrylamide/acrylic acid copolymer (molar ratio of 60/20/20)
(32) N-vinylpyrrolidone/acrylamide/vinyl acetate/acrylic acid copolymer (molar ratio of 60/20/10/10)
(33) N-vinylpyrrolidone/dimethylacrylamide copolymer (molar ratio of 70/30)

The addition of said polymers to an emulsion may be carried out in a conventional manner for the addition of photographic additives to a photographic emulsion. For instance, the polymer is first dissolved in a solvent which does not have any harmful influence on photographic materials which are the final products (such as water, or an alkaline aqueous solution), and then the resulting polymer-containing solution is added to an emulsion.

In the present invention, at least one of the polymers having repeating units of formula (I) as described above is added to chemically-sensitized normal crystalline silver halide grains. After the addition, ripening of the emulsion may be further continued. Said addition may be carried out before or during the chemical-sensitization step of the emulsion.

In the formation of silver halide grains or physical ripening or the grains to the present invention, a cadmium salt, a zinc salt, a lead salt, a thallium salt, an iridium salt, or a complex thereof, a rhodium salt or a complex thereof, an iron salt, or a completx thereof, and the like may be present in the system. These process are described in *Research Disclosure*, Vol. 1, RD No. 17643 (December, 1978), p. 22.

Photographic emulsions used in the present invention can contain various compounds for the purpose of preventing fog during preparation, storage, or photographic processing, or for stabilizing photographic images formed. Such compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc; mercaptopyrimidines; mercaptotriazines; thioketo compounds, such as oxazolinethione, etc.; azaindenes, such as triazaindenes, tetraazaindenes (especially 4-hydroxy-substituted (1,3,3a,7)-tetraazaindenes), pentaazaindenes, etc.; benzenethiosulfonic acid; benzenesulfinic acid; benzenesulfonic acid amide; and other various compounds known as anti-foggants or stabilizers. Such compounds are described in more detail, e.g., in U.S. Pat. Nos. 3,954,474 and 3,982,947 and Japanese Patent Publication No. 28660/77.

The photographic emulsions which can be used in the present invention may be spectrally sensitized with methine dyes and other sensitizing dyes. Useful sensitizing dyes include cyanine dyes, merocyanine dyes, complex cyanine dyes, complex merocyanine dyes, holopolar cyanine dyes, hemicyanine dyes, styryl dyes, and hemioxonol dyes, with cyanine dyes, merocyanine dyes, and complex merocyanine dyes being particularly useful. Any of basic heterocyclic nuclei generally used for cyanine dyes can be applied to these dyes. Such nuclei include pyrroline, oxazoline, thiazoline, pyrrole, oxazole, thiazole, selenazole, imidazole, tetrazole, pyridine nuclei, and the like; the above-described nuclei to which an alicyclic hydrocarbon ring is fused; and the above-described nuclei to which an aromatic hydrocarbon ring is fused, such as indolenine, benzindolenine, indole, benzoxazole, naphthoxazole, benzothiazole, naphthothiazole, benzoselenazole, benzimidazole, quinoline nuclei, etc. These nuclei may be substituted at their carbon atoms.

Nuclei having a keto-methylene structure can be used for merocyanine dyes or complex merocyanine dyes. Such nuclei include 5- to 6-membered heterocyclic nuclei, such as pyrazolin-5-one, thiohydantoin, 2-thiooxazolidine-2,4-dione, thiazolidine-2,4-dione, rhodanine, thiobarbituric acid nuclei, and the like.

The above-described sensitizing dyes may be used alone or in combinations of two or more thereof. Combinations of sensitizing dyes are frequently employed for the purpose of supersensitization. Typical examples of supersensitizing combinations are described in *Research Disclosure*, Vol. IV (e.g., particularly E, F, and J), RD No. 17643 (December, 1978), p. 22.

The photographic emulsions may additionally contain a substance which has an effect of supersensitization when used in combination with sensitizing dyes even though it does not per se exhibit spectral sensitizing effects or does not substantially absorb visible light.

The photographic materials of the present invention may contain various kinds of color couplers, and examples thereof are described in patent publications as referred to in the aforesaid *Research Disclosure*, RD No. 17643, Items VII-C through VII-G (December, 1978). As the color couplers, those capable of yielding three primary colors in subtractive color process (i.e., yellow, magenta, and cyan) by color development are important, and examples of non-diffusive tetra-equivalent or di-equivalent couplers which may be used in the present invention are described in the patent publications as referred to in said *Research Disclosure*, RD No. 17643, Items VII-C and VII-D (December, 1978). In addition, the following couplers may also be used in the present invention.

As yellow couplers which may be used in the present invention, hydrophobic acylacetamide-type couplers having a ballast group are typical. Examples of said couplers are described in U.S. Pat. Nos. 2,407,210, 2,875,057, and 3,265,506. In the present invention, di-equivalent yellow couplers are preferably used, and typical examples thereof are oxygen atom-releasing type yellow couplers as described, for example, in U.S. Pat. Nos. 3,408,194, 3,447,928, 3,933,501, and 4,022,620; and nitrogen atom-releasing type yellow couplers as described, for example, in Japanese Patent Publication No. 10739/83, U.S. Pat. Nos. 4,401,752 and 4,326,024, *Research Disclosure*, RD No. 18053 (April, 1979), British Pat. No. 1,425,020, West German Patent Application (OLS) Nos. 2,219,917, 2,261,361, 2,329,587, and 2,433,812. α-pivaloyl-acetanilide type couplers have good fastness, especially against light, in the formed dyes. On the other hand, α-benzoylacetanilide type couplers can obtain dyes of high color density.

As magneta couplers which may be used in the present invention, ballast group-containing hydrophobic indazolone-type or cyanoacetyl-type, preferably 5-pyrazolone-type and pyrazolo-azole-type, couplers are typical. Regarding the 5-pyrazolone-type couplers, those which are substituted by an arylamino or acylamino group in the 3-position are preferred from the viewpoints of the hue of the formed dyes or the color density thereof, and typical examples of said couplers are described, for example, in U.S. Pat. Nos. 2,311,082, 2,343,703, 2,600,788, 2,908,573, 3,062,653, 3,152,896, and 3,936,015. As the releasing groups in the di-equivalent 5-pyrazolone-type couplers, nitrogen atom-releasing groups as described in U.S. Pat. No. 4,310,619 or arylthio groups as described in U.S. Pat. No. 4,351,897 are especially preferred. Ballast group-containing 5-pyrazolone-type couplers as described in European Pat. No. 73,636 can form dyes of high color density. As the pyrazolo-azole type couplers, pyrazolobenzimidazoles as described in U.S. Pat. No. 3,369,879, preferably pyrazolo[5,1-c][1,2,4]triazoles as described in U.S. Pat. No. 3,725,067, pyrazolo-tetrazoles as described in *Research Disclosure*, RD No. 24220 (June, 1984), and Japanese Patent Application (OPI) No. 33552/85, and pyrazolo-pyrazoles as described in *Research Disclosure*, RD No. 24230 (June, 1984) and Japanese Patent Application (OPI) No. 43659/85 are mentioned. From the viewpoint of the light-fastness of the formed dyes with low yellow-subabsorption, imidazo[1,2-b]pyrazoles as described in U.S. Pat. No. 4,500,630 are preferred, and pyrazolo[1,5-b][1,2,4]triazoles as described in European Pat. No. 119,860A are especially preferred.

As cyan couplers which may be used in the present invention, hydrophobic and non-diffusible naphthol-type or phenol-type couplers are mentioned; and typical couplers are naphthol-type couplers as described in U.S. Pat. No. 2,474,293 and especially preferably oxygen atom-releasing type di-equivalent naphthol-type couplers as described in U.S. Pat. Nos. 4,052,212, 4,146,396, 4,228,233, and 4,296,200. Examples of phenol-type couplers are described in U.S. Pat. Nos. 2,369,929, 2,801,171, 2,772,162, and 2,895,826.

Cyan couplers that are resistant to moisture and high temperature are preferably used in the present invention, and typical examples thereof are phenol-type cyan couplers having a higher alkyl group than ethyl group in the meta-position of the phenol nucleus thereof, as described in U.S. Pat. No. 3,772,002; 2,5-diacylamino-substituted phenol-type couplers as described in U.S. Pat. Nos. 2,772,162, 3,758,308, 4,126,396, 4,334,011, and 4,327,173, West German Patent Application (OLS) No. 3,329,729 and European Pat. No. 121,365; and phenol-type couplers having a phenylureido group in the 2-position and an acylamino group in the 5-position, as described in U.S. Pat. Nos. 3,446,622, 4,333,999, 4,451,559, and 4,427,767.

In order to compensate any unnecessary absorption of the formed dyes, masking is preferably applied to color photographic materials for camera by incorporating colored couplers therein. Typical examples of the colored couplers to be used therefor are yellow-colored magenta couplers as described in U.S. Pat. No. 4,163,670 and Japanese Patent Publication No. 39413/82 and magenta-colored cyan couplers as described in U.S. Pat. Nos. 4,004,929 and 4,138,258 and British Pat. No. 1,146,368. Other colored couplers which may be used in the present invention are described in the aforesaid *Research Disclosure*, RD No. 17643, Item VII-G (December, 1978).

A coupler which may form a color-dye having a proper diffusibility can be used together with the above-mentioned coupler in the present invention, whereby the graininess of the emulsion can be improved. Various couplers of said kind are known, including magenta couplers as described in U.S. Pat. No. 4,366,237 and British Pat. No. 2,125,570; and yellow, magenta, and cyan couplers as described in European Pat. No. 96,570 and West German Patent Application (OLS) No. 3,234,533.

The dye-forming couplers and the above-described special couplers may be in the form of a dimer or more polymers. Typical examples of dye-forming coupler polymers are described in U.S. Pat. Nos. 3,451,820 and 4,080,211. Examples of magenta coupler polymers are described in British Pat. No. 2,102,173 and U.S. Pat. No. 4,367,282.

Couplers which may release photographically useful groups in coupling can preferably be used in the present invention. DIR-couplers which release a development-inhibitor are described in various patent publications as referred to in the aforesaid *Research Disclosure*, RD No. 17643, Item VII-F (December, 1978), and these are advantageously used in the present invention.

Examples of said couplers which may preferably be used in the present invention are developer-inactivating couplers as described, for example, in Japanese Patent Application (OPI) No. 151,944/82; timing-type couplers as described, for example, in U.S. Pat. No. 4,248,962 and Japanese Patent Application (OPI) No. 154,234/82; and reactive-type couplers as described in Japanese Patent Application No. 39653/84; and in particular, developer-inactivating type DIR couplers as described in Japanese Patent Application (OPI) Nos. 151,944/82 and 217,932/83, and Japanese Patent Application Nos. 75474/84, 82214/84, and 90438/84, and reactive type-DIR couplers as described in Japanese Patent Application No. 39653/84 are especially preferred.

The emulsions to be used in the present invention are preferably physically-ripened, chemically-ripened, and spectrally-sensitized. Additives to be used in the steps for said ripening or sensitization are described in *Research Disclosure*, RD No. 17643 (December, 1978) and RD No. 18716 (November, 1979), particularly in the portions of said literature set forth below.

In addition, conventional photographic additives which may be used in the present invention are also described in said two *Research Disclosure* publications, and the relevant portions thereof are also set forth in the following Table.

| No. | Kinds of Additives | RD No. 17643 | RD No. 18716 |
|---|---|---|---|
| 1 | Chemical sensitizer | p.23 | P.648, right column |
| 2 | Sensitivity accelerator | | P.648, right column |
| 3 | Spectral sensitizer, Super-sensitizer | pp.23–24 | p.648, right column-p.649, right column |
| 4 | Brightening agent | p.24 | — |
| 5 | Antifoggants, stabilizer | pp.24–25 | p.649, right column |
| 6 | Light-absorbent, filter dye, UV-absorbent | pp.25–26 | p.649, right column-p.650, left column |
| 7 | Stain-inhibitor | p.25, right column | p.650, right to left column |
| 8 | Color image stabilizer | p.25 | — |
| 9 | Hardener | p.26 | p.651, left column |
| 10 | Binder | p.26 | p.651, left column |
| 11 | Plasticizer, lubricant | p.27 | p.650, right column |
| 12 | Coating aid, surfactant | p.26–27 | p.650, right column |
| 13 | Anti-static agent | p.27 | p.650, right column |

The photographic materials of the present invention may be any of black-and-white photographic materials and multi-layer multi-color photographic materials, and in particular, the present photographic materials are preferably used as color light-sensitive materials for high-speed photography.

In the case of applying the present invention to color light-sensitive materials, the layer in which the emulsion according to the present invention is present is not particularly restricted, but it is preferred to be used in a blue-sensitive layer, particularly a high-speed blue-sensitive layer. Further, it is preferred that fine silver halide grains having a grain size of 0.2 μm or less are allowed to exist so as to be adjacent to said emulsion layer.

Conventional methods and processing solutions can be applied to photographic processing of the light-sensitive materials according to the present invention. Processing temperatures are generally selected from the range of from 18° to 50° C. However, temperatures lower than 18° C. or higher than 50° C. may also be employed. Any photographic processing, including monochromatic photographic processing involving formation of a silver image, and color photographic processing involving formation of a dye image, can be used, depending on the desired end use of the light-sensitive material.

In particular, when the photographic materials of the present invention are developed by a so-called parallel development, which is a typical color development, extremely favorable results may be obtained in terms of sensitivity and graininess. For said development, the photographic materials of the present invention may be processed in a conventional manner as described in detail in the aforesaid *Research Disclosure*, RD No. 17643 (December, 1978), pp. 28–29 and ibid., RD No. 18716 (November, 1979), p. 651, left to right column.

The present invention is explained in greater detail by reference to the following examples, which, however, are not intended to be interpreted as limiting the scope of the present invention.

EXAMPLE 1

In the manner of Example 1 of Japanese Patent Application (OPI) No. 143,331/85, twinned-crystal emulsion Nos. 1 through 3 were prepared, whereupon the addition time and other conditions were varied. Referring to Example 2 of said Patent Application, octadehral crystal emulsion Nos. 4 through 7 were prepared analogously. The characteristics of the emulsions formed are shown in Table 1.

TABLE 1

| Emulsion No. | Shape of grains | Average grain size (μm) | I-content (mole %) in composition prescribed Core | Shell | Core/Shell Ratio (volume ratio) | Average I-content (mole %) | Existence of definite stratified structure in grains |
|---|---|---|---|---|---|---|---|
| 1 | twinned crystals | 1.7 | 30 | 0 | 1/2 | 10 | A |

TABLE 1-continued

| Emulsion No. | Shape of grains | Average grain size (μm) | I-content (mole %) in composition prescribed Core | Shell | Core/Shell Ratio (volume ratio) | Average I-content (mole %) | Existence of definite stratified structure in grains |
|---|---|---|---|---|---|---|---|
| 2 | twinned crystals | 2.1 | 42 | 0 | 1/2 | 14 | B |
| 3 | twinned crystals | 1.6 | 2 | 2 | — | 2 | A |
| 4 | octahedron | 2.0 | 0 | 0 | — | 0 | A |
| 5 | octahedron* | 2.0 | 5 | 0 | 1/1 | 2.5 | A |
| 6 | octahedron* | 2.0 | 20 | 0 | 1/1 | 10 | B |
| 7 | octahedron* | 2.0 | 40 | 0 | 1/1 | 20 | B |

(Notes)
1. A: No distinct stratiform structure exists.
B: A distinct stratiform structure exists.
2. *: This could also be considered as a tetradecahedron which is extremely near to an octahedron, containing about 5% of the face (100) and the balance of the face (111).

Each of the above seven emulsions was chemically-sensitized with sodium thiosulfate and chloroauric acid under optimum conditions, to obtain samples of coating solutions. On a triacetyl-cellulose film support having a subbing layer were coated an emulsion layer and a protective layer, and the composition of the coated layer is given in Table 2.

Poly(N-vinylpyrrolidone) (hereinafter, referred to as "PVP") was added to each emulsion in an amount of from 0 to 10 g per mole of silver contained therein.

TABLE 2

(1) Emulsion layer:
Emulsion: one of Emulsion Nos. 1-8 shown in Table 1 (silver content: $2.1 \times 10^{-2}$ mole/m$^2$)
Coupler ($1.5 \times 10^{-3}$ mole/m$^2$)

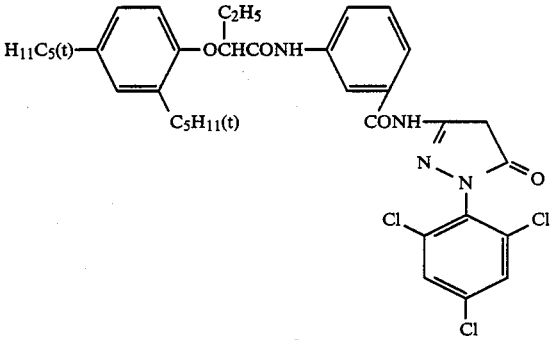

Tricresyl phosphate (1.10 g/m$^2$)
Gelatin (2.30 g/m$^2$)
(2) Protective layer:
2,4-dichlorotriazine-6-hydroxy-s-triazine-sodium salt (0.08 g/m$^2$)
Gelatin (1.80 g/m$^2$)

The above-formed samples were allowed to stand under a condition of 40° C. and relative humidity of 70%, for 14 hours, and then exposed to light for sensitometry and then developed according to the following color development.

The color development was carried out at 38° C. under the following conditions:

| | |
|---|---|
| 1. Color development | 2 min. 45 sec. |
| 2. Bleaching | 6 min. 30 sec. |
| 3. Water-washing | 3 min. 15 sec. |
| 4. Fixing | 6 min. 30 sec. |
| 5. Water-washing | 3 min. 15 sec. |
| 6. Stabilization | 3 min. 15 sec. |

The composition of the treating solution used in each of the above treatment steps was as follows:

| | |
|---|---|
| Color developer: | |
| Sodium nitrilo-triacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxyethylamino)-2-methyl-aniline.sulfate | 4.5 g |
| Water to make | 1 liter |
| Bleaching solution: | |
| Ammonium bromide | 160.0 g |
| Aqueous ammonia (28 wt %) | 25.0 ml |
| Ethylenediamine-sodium tetraacetate-iron complex | 130 g |
| Glacial acetic acid | 14 ml |
| Water to make | 1 liter |
| Fixer: | |
| Sodium tetrapoly-phosphate | 2.0 g |
| Sodium sulfite | 4.0 g |
| Ammonium thiosulfate (70 wt %) | 175.0 ml |
| Sodium bisulfite | 4.6 g |
| Water to make | 1 liter |
| Stabilizer: | |
| Formalin (37 wt % formaldehyde solution) | 8.0 ml |
| Water to make | 1 liter |

The color density of each of thus-treated samples was measured with a green filter. The results of the obtained photographic characteristics for the samples are set forth in the following Table 3.

TABLE 3

| Emulsion No. | Amount of added PVP (q/mole-Ag) | Relative sensitivity | Fog |
|---|---|---|---|
| 1 | 0 | 430 | 0.14 |
| 1 | 0.4 | 380 | 0.12 |
| 2 | 0 | 720 | 0.15 |
| 2 | 0.4 | 650 | 0.12 |
| 3 | 0 | 280 | 0.18 |
| 3 | 0.4 | 240 | 0.15 |
| 4 | 0 | 100 | 0.28 |
| 4 (Invention) | 0.4 | 120 | 0.30 |
| 5 | 0 | 140 | 0.19 |
| 5 (Invention) | 0.4 | 170 | 0.19 |
| 6 | 0 | 800 | 0.10 |
| 6 (Invention) | 0.4 | 1270 | 0.10 |
| 7 | 0 | 780 | 0.08 |
| 7 (Invention) | 0.4 | 1200 | 0.08 |

In the above sample Nos. 4 through 7, the sensitivity extremely increased due to the addition of PVP. In the other samples containing emulsions of twinned grains, however, the sensitivity did not increase at all even after the addition of said PVP. The results of the Table 3 therefore prove that the sensitivity of the emulsions containing normal crystalline grains of the present invention noticeably increases due to the addition of PVP, and further, the increment of the sensitivity is more remarkable in the emulsions containing grains having a distinct stratiform structure.

While the invention has been described in detail and with reference to specific embodiments thereof, it will be apparent to one skilled in the art that various changes and modifications can be made therein without departing from the spirit and scope thereof.

What is claimed:

1. A negative-type silver halide photographic material having at least one surface latent image silver halide emulsion layer on a support, wherein chemically-sensitized silver halide grains contained in the emulsion of said emulsion layer comprise normal crystalline grains, and said emulsion layer containing said normal crystalline silver halide grains comprises a protective colloid or a binder and a polymer having a repeating unit represented by formula (I) which increases the sensitivity of the silver halide emulsion:

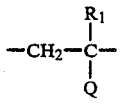

(I)

wherein $R_1$ represents a hydrogen atom or an alkyl group; Q represents one group selected from formulae (i), (ii), (iii), and (iv);

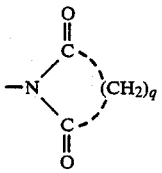

(i)

wherein q is an integer of from 2 to 4;

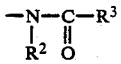

(ii)

wherein $R^2$ and $R^3$ each represents a hydrogen atom or an alkyl group;

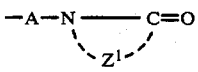

(iii)

wherein $Z^1$ represents an atomic group forming a lactam ring, an oxazolidone ring, or a pyridone ring;

A represents a single bond,

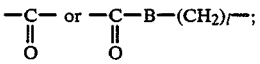

B represents —O— or

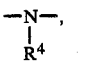

wherein $R^4$ represents a hydrogen atom or an alkyl group; and l is an integer of from 1 to 6; and

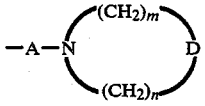

(iv)

wherein

A has the same meaning as defined for formula (iii);

D represents a single bond, —O— or

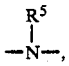

wherein $R^5$ represents a hydrogen atom, an alkyl group, or

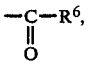

wherein $R^6$ represents an alkyl group; and m and n each represents an integer of from 1 to 6, provided that the sum of m and n is an integer of from 4 to 7, wherein the amount of the polymer having the repeating unit represented by formula (I) is smaller than the amount of the polymer which is used as a protective colloid or binder, the amount of the polymer having a repeating unit represented by formula (I) being from 0.02 to 5 g per mole of silver used.

2. A negative-type silver halide photographic material as in claim 1, wherein the normal crystalline silver halide grains in the emulsion are regular crystalline grains comprising cubic, octahedral, dodecahedral and tetradecahedral crystalline grains.

3. A negative-type silver halide photographic material as in claim 1, wherein the volume fraction of the normal crystalline grains in the emulsion is 50% or more.

4. A negative-type silver halide photographic material as in claim 2, wherein the volume fraction of the normal crystalline grains in the emulsion is 50% or more.

5. A negative-type silver halide photographic material as in claim 1, wherein the normal crystalline silver halide grains in the emulsion are those having 50% or more of the face (111).

6. A negative-type silver halide photographic material as in claim 1, wherein the normal crystalline silver halide grains in the emulsion have substantially two distinct stratiform structures comprising a core part of a higher iodine layer and a shell part of a lower iodine layer.

7. A negative-type silver halide photographic material as in claim 1, wherein $R^1$ in formula (I) represents hydrogen atom and Q in formula (I) represents a group selected from the groups (1), (2), (3), and (4):

(1)

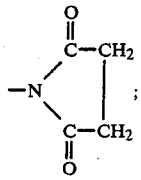

(2)

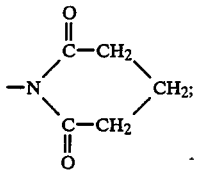

(3)

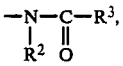

wherein $R_2$ represents a methyl group or an ethyl group, and $R^3$ represents a hydrogen atom, a methyl group, or an ethyl group;

(4)

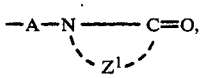

wherein A represents a single bond or

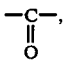

and $Z^1$ forms a 5-membered or 6-membered lactam ring or oxazolidone ring.

8. A negative-type silver halide photographic material as in claim 1, wherein Q in formula (I) represents

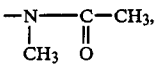

a pyrrolidone group, or an oxazolidone group.

9. A negative-type silver halide photographic material as in claim 1, wherein the volume fraction of the normal crystalline grains in the emulsion is 75% or more.

10. A negative-type silver halide photographic material as in claim 1, wherein the iodide content of a core part in the normal crystalline silver halide grains having a distinct stratiform structure is in a range of from 10 to 45 mole %.

11. A negative-type silver halide photographic material as in claim 1, wherein the composition of a shell part of an uppermost layer in the normal crystalline silver halide grains having the distinct stratiform structure consists of silver halides containing 5 mole % or less of silver iodide.

12. A negative-type silver halide photographic material as in claim 1, wherein the total silver iodide content of the whole normal crystalline silver halide grains having the distinct stratiform structure is 7 mole % or more.

13. A negative-type silver halide photographic material as in claim 1, wherein the ratio of silver content in the core part to the shell part in the normal crystalline silver halide grains having the distinct stratiform structure is in a range of from 1/5 to 5/1.

14. A negative-type silver halide photographic material as in claim 1, wherein the polymer having a repeating unit represented by formula (I) contains from 10 to 100 mole % of the component of formula (I).

15. A negative-type silver halide photographic material as in claim 1, wherein the amount of the polymer having a repeating unit represented by formula (I) is from 0.1 to 2 g per mole of silver used.

* * * * *